United States Patent [19]

Sasaki et al.

[11] Patent Number: 4,835,352

[45] Date of Patent: May 30, 1989

[54] PACKAGE MATERIAL FOR MICROWAVE COOKING

[75] Inventors: Hiroaki Sasaki; Minoru Toyoda; Jun Sada; Sueo Takahashi; Shigeru Suzuki, all of Tokyo, Japan

[73] Assignees: Toppan Printing Co., Ltd., Japan; Nippon Suisan Kaisha, Ltd., Japan

[21] Appl. No.: 115,712

[22] Filed: Nov. 2, 1987

[30] Foreign Application Priority Data

Nov. 5, 1986 [JP] Japan ..... 61-169828[U]
May 8, 1987 [JP] Japan ..... 62-69267[U]

[51] Int. Cl.[4] ..... H05B 6/64

[52] U.S. Cl. ..... 219/10.55 E; 219/10.55 F; 99/DIG. 14; 426/107; 426/243

[58] Field of Search ..... 219/10.55 F, 10.55 E, 219/10.55 R; 426/107, 234, 241, 243; 99/DIG. 14; 126/390; 229/3.5 MF

[56] References Cited

U.S. PATENT DOCUMENTS

| | | | |
|---|---|---|---|
| 4,196,331 | 4/1980 | Leveckis et al. | 219/10.55 E |
| 4,230,924 | 10/1980 | Brastad et al. | 219/10.55 E |
| 4,268,738 | 5/1981 | Flautt, Jr. et al. | 219/10.55 F |
| 4,641,005 | 2/1987 | Seiferth | 219/10.55 E |
| 4,656,325 | 4/1987 | Keefer | 219/10.55 E |
| 4,676,857 | 6/1987 | Scharr et al. | 219/10.55 EX |

FOREIGN PATENT DOCUMENTS 60-15548 4/1985 Japan .

*Primary Examiner*—Philip H. Leung
*Attorney, Agent, or Firm*—Lerner, David, Littenberg, Krumholz & Mentlik

[57] ABSTRACT

The present application is directed to a package material for microwave cooking which is obtained by integrally laminating a microwave heating element, which generates heat when irradiated with microwave, to a base material to form a sheet; and providing, on the sheet, many slits in the form of broken lines, in parallel, and in alternation between the adjacent ones.

4 Claims, 3 Drawing Sheets

PACKAGE MATERIAL FOR MICROWAVE COOKING

FIELD OF THE INVENTION

The present invention relates to a package material for microwave cooking, and particularly it relates to a package material which is capable of giving suitable scorches on the surface of a cooked food.

DESCRIPTION OF THE PRIOR ART

Heretofore, as disclosed in Japanese Patent Publication No. 15548/1985, a package material for microwave cooking has been constituted by first superposing an aluminum-deposited layer, which generates heat on the absorption of microwave, on a heat-resistant plastic film such as a polyethylene terephthalate film, and then integrally laminating a base material such as a paper to this aluminum-deposited layer. In cooking a food, the latter is wrapped in such a package material and is then placed in a microwave oven. Nowadays, such a cookery is often utilized.

However, in the case of the cookery of using the above-mentioned package material, the food wrapped in the package material cannot be observed visually therethrough, and therefore a degree of the scorch is not confirmable. In addition, water vapor generated in the package is confined therein, so that an exothermic efficiency deteriorates, with the result that a scorch state on the food is bad disadvantageously. Furthermore, the above-mentioned package material has the drawback that it cannot pack the food so as to tightly fit to its shape.

SUMMARY OF THE INVENTION

An object of the present invention is to provide a package material for microwave cooking by which water vapor generated from a food under cooking is easily released out, suitable scorches are marked on the outer surface of the cooked food, and the food is fitly wrapped in conformity with its shape.

That is, the present invention has been achieved with the intention of solving the above-mentioned conventional problems, and according to the present invention, there is provided a package material for microwave cooking which is obtained by integrally laminating a heating element to a base material such as a paper to form a sheet, the above heating element being composed of a metallic layer, which is formed by the vapor deposition of a metal such as aluminum and which generates heat on the absorption of microwave, and a heat-resistant plastic film layer with which the metallic layer is covered; and providing, on the thus formed sheet, many slits in the form of broken lines, in parallel, and in alternation between the adjacent ones.

DESCRIPTION OF THE PREFERRED EMBODIMENT

Now, the present invention will be described in detail in reference to drawings attached hereto.

Figure 1:
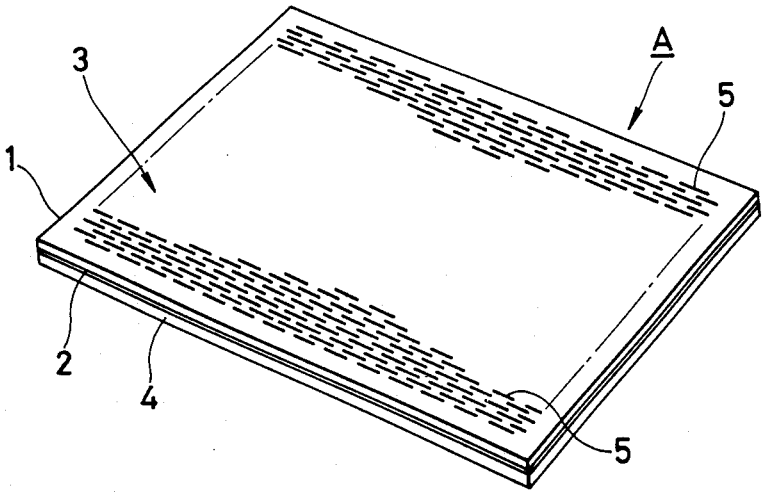
FIG. 1 is a perspective view showing a package material for microwave cooking with regard to the present invention.
Figure 2:
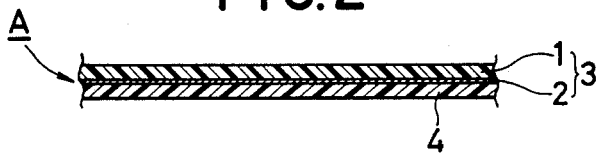
FIG. 2 is an explanatory view showing a section of an essential part of one embodiment regarding the present invention.

FIG. 1 is an explanatory view of a package material for microwave cooking regarding the present invention. Reference numeral 1 in this drawing is a heat-resistant plastic film layer comprising a polyethylene terephthalate film. On this heat-resistant plastic film 1, a metallic layer 2 of aluminum is vacuum vapor-deposited to form a heating element 3 in which the metallic layer 2 generates heat on absorbing microwave. Then, this heating element 3 is integrally laminated all over to a base material 4 such as a paper in order to form a sheet A in which the heat-resistant plastic film layer 1, the metallic layer 2 and the base material 4 are laminated together (see FIG. 2)

Figure 5:
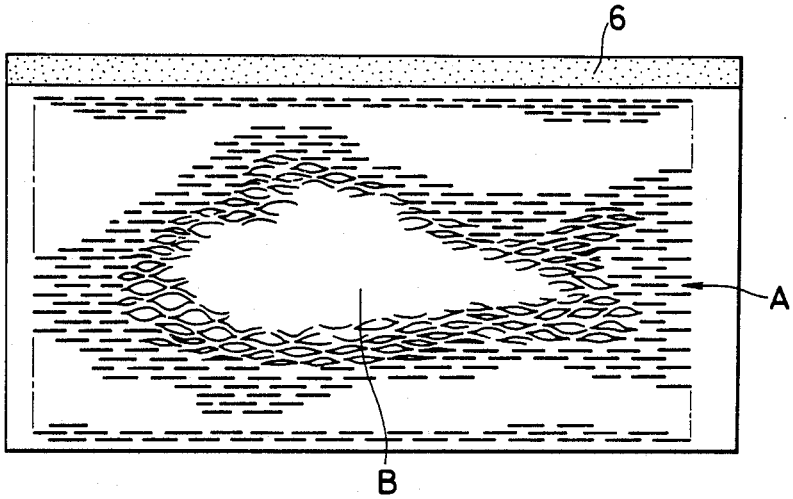
FIG. 5 is an explanatory view illustrating the state where a food is wrapped in the package material.
Figure 6:
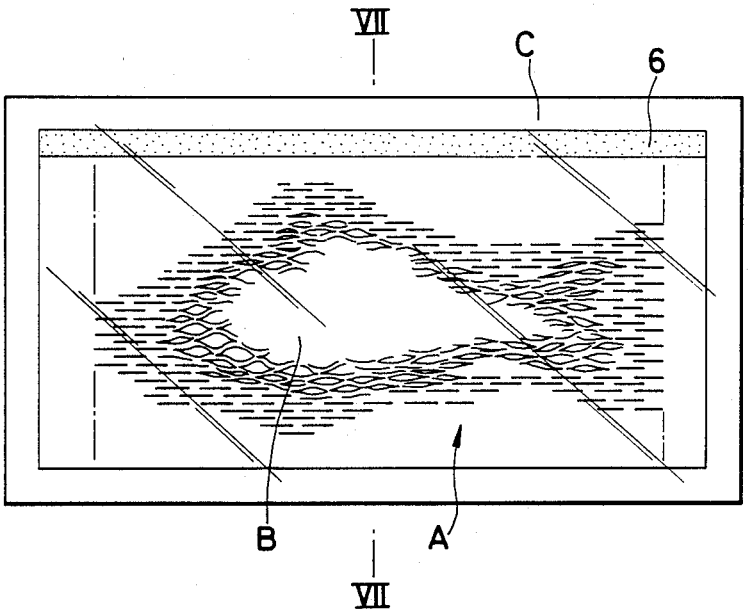
FIG. 6 is an explanatory view illustrating a package morphology for transportation.
Figure 7:
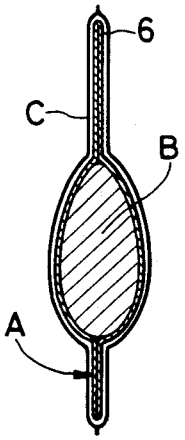
FIG. 7 is a sectional view taken along the line VII—VII in FIG. 6.

On the sheet A, many slits 5 are provided in the form of broken lines, in parallel, and in alternation between the adjacent ones. The thus obtained package material for microwave cooking can stretch in a direction across at right angles to the array direction of the slits. Therefore, when a food B (e.g., a fish) to be cooked is wrapped in the package material and the latter is then sealed along its one edge 6 as shown in FIG. 5, the respective slits 5 are opened, so that packaging can be accomplished in conformity with the shape of the food B. And when the thus packed food B is placed in a microwave oven, water vapor can be released out through the open slits 5, and a suitable degree of the scorch can be obtained on the food B and net-like scorches can be marked thereon.

In the course of transportation, the food B (see FIG. 5) packed in the package material of the present invention may be received in an outer bag C and then confined therein tightly by means of vacuum packaging. In this case, the food B is retained in the sheet A in a closely adherent state, and therefore when the food B is taken out from the outer bag C and is placed in the microwave oven, the above-mentioned effect can be more improved. The outer bag C may be made from a plastic film such as a polypropylene film or its laminate.

Figure 8:
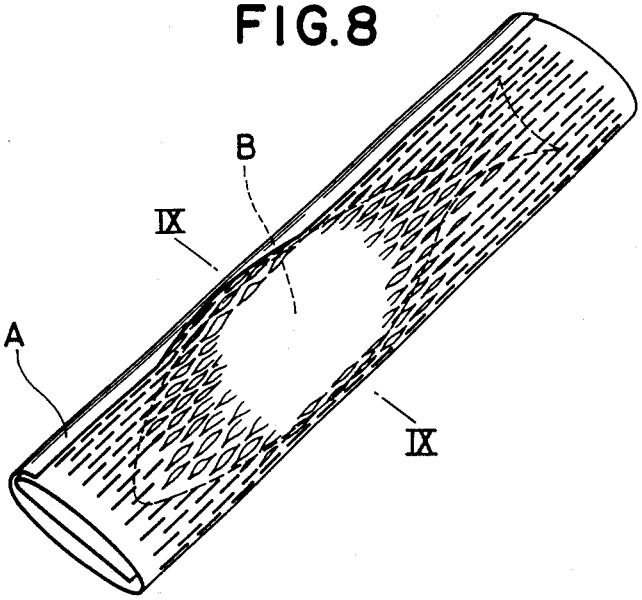
FIG. 8 is a perspective view showing the state where another food is wrapped in the package material.
Figure 9:
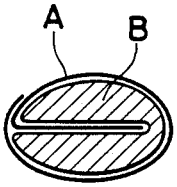
FIG. 9 is a sectional view taken along the line IX—IX in FIG. 8.

Further, in the case that a back cutting or belly cutting dried fish as the food B is wrapped in the package material of the present invention and is then cooked in the microwave oven, the said opened fish may be wrapped in the sheet A, as it is. However, as shown in FIGS. 8 and 9, the opened fish (food B) may be folded with the interposition of one edge portion of the sheet A therebetween. In such a way, a use area of the sheet A is small, which fact is economical, and the inner surfaces of the folded fish can have scorches. In this case, the sheet A may be fastened with a label, or alternatively the whole of the packed food B may be subjected to a pillow deaeration packaging treatment so that the sheet A may adhere closely to the food B.

Figure 10:
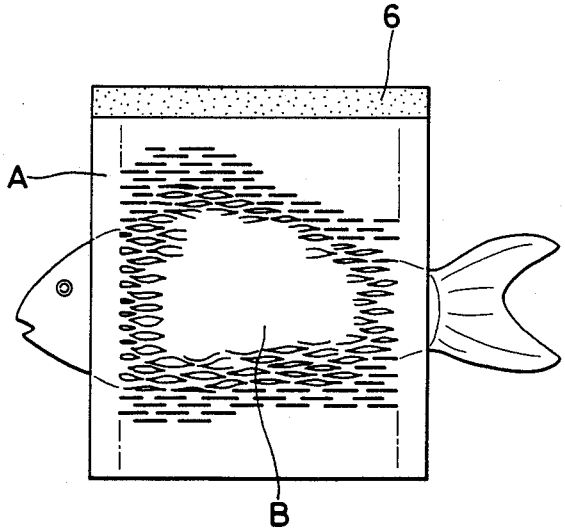
FIG. 10 is an explanatory view illustrating the state where still another food is wrapped in the package material.

Furthermore, in the case that some parts of the food B such as a tail and fins of the fish are liable to excessively scorch by heat, some portions alone of the food B for which suitable scorches are desired may be wrapped in the sheet A, as shown in FIG. 10. This manner permits finely scorching the optional portions alone on the food B.

Figure 3:
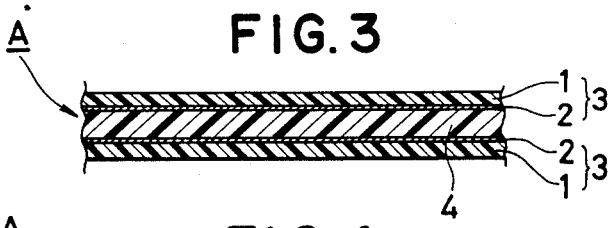
FIG. 3 is an explanatory view showing another embodiment through its section.
Figure 4:
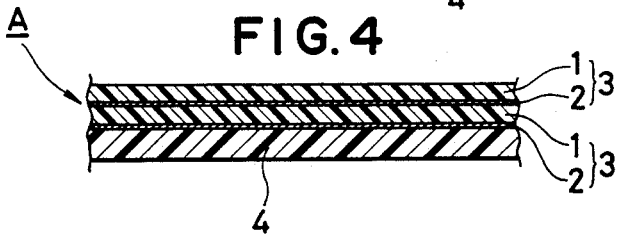
FIG. 4 is an explanatory view showing still another embodiment through its section.

The above-mentioned sheet A is not limited to the layer structure in which the heating element 3 is integrally laminated to either surface of the base material 4. As shown in FIG. 3, the heating element 3 may be integrally laminated to the opposite surfaces of the base material 4 so that the metallic layers 2 may be positioned on the opposite sides of the base material 4. Further, as shown in FIG. 4, the sheet A may be formed by laminating the two heating element layers to either surface of the base material 4.

As described above, according to the present invention, the package material for microwave cooking comprises the sheet which is made by integrally laminating the heating element to the base material such as a paper, the heating element being composed of the heat-resistant plastic film layer and the heat-generating metallic layer. And on this sheet, many slits are provided in the form of broken lines, in parallel, and in alternation between the adjacent ones. Therefore, when a food is wrapped in the package material, the latter can be freely stretched in conformity with the shape of the food, and water vapor which generates by heating in a microwave oven is easily released through the opened slits, so that there can be avoided the conventional disadvantage that the surfaces of the food are softened with water. Instead, a suitable scorch state can be obtained, and net-like scorches can be marked on the food. In consequence, it is fair to say that the present invention can display the practically excellent effect.

What is claimed is:

1. A package material for packages which are adapted to tightly and conformably wrap about a food for microwave irradiation, said package material comprising, at least one heating element integrally laminated to a base material to form a sheet, said at least one heating element being composed of a metallic layer which is formed by the vacuum vapor deposition of a metal and which generates heat on the absorption of microwave, and a heat-resistant plastic film layer with which said metallic layer is covered; and providing, on said sheet, many slits in the form of broken lines, in parallel, and in alternation between adjacent slits.

2. A package material for microwave cooking according to claim 1 wherein two heating elements are laminated to the opposite surfaces of said base material.

3. A package material for microwave cooking according to claim 1 wherein two heating elements are laminated to one surface of said base material.

4. A package material for microwave cooking according to claim 1 wherein said base material is paper and said metal is aluminum.

* * * * *